United States Patent [19]

Wainscott

[11] Patent Number: 4,745,661

[45] Date of Patent: May 24, 1988

[54] CORD ATTACHMENT FOR LOCATION OF CIGARETTE LIGHTER

[75] Inventor: Victor E. Wainscott, St. Petersburg, Fla.

[73] Assignee: Creative Marketing, Inc., St. Petersburg, Fla.

[21] Appl. No.: 34,738

[22] Filed: Apr. 6, 1987

[51] Int. Cl.[4] ..... A45F 5/02

[52] U.S. Cl. ..... 24/3 M; 24/3 J; 24/562; 150/106

[58] Field of Search ..... 24/3 M, 3 R, 3 H, 3 J, 24/3 K, 3 L, 3 E, 562, 564, 567; 150/106, 112, 115

[56] References Cited

U.S. PATENT DOCUMENTS

| | | | |
|---|---|---|---|
| 1,034,107 | 7/1912 | Guy | 150/106 |
| 1,475,974 | 12/1923 | Torrey | 24/3 M |
| 1,490,871 | 4/1924 | Wagner | 24/3 M |
| 1,835,749 | 12/1931 | Behrman | 150/106 |
| 2,071,757 | 2/1937 | Matthews | 24/3 M |
| 2,503,501 | 4/1950 | Lutz | 150/106 |
| 3,069,539 | 12/1962 | Kidd | 24/3 J |
| 3,326,258 | 6/1967 | Stucker | 150/106 |
| 4,004,325 | 1/1977 | Hubachek | 24/3 K |
| 4,361,934 | 12/1982 | Darnell | 24/3 M |
| 4,616,113 | 10/1986 | Jank et al. | 24/562 |

FOREIGN PATENT DOCUMENTS

| | | | |
|---|---|---|---|
| 1488256 | 7/1967 | France | 24/3 K |

*Primary Examiner*—Victor N. Sakran
*Attorney, Agent, or Firm*—Walter J. Monacelli

[57] ABSTRACT

The device described herein comprises a cord or chain, preferably an elastic cord, with means for fastening one end to a cigarette lighter and means such as a clip, at the other end for attaching the cord to a portion of a lady's purse or to an article of a man's clothing. This device facilitates the finding and retrieval of the cigarette lighter.

6 Claims, 1 Drawing Sheet

CORD ATTACHMENT FOR LOCATION OF CIGARETTE LIGHTER

BACKGROUND OF THE INVENTION

1. Field of the Invention

This invention relates to a cord device to facilitate location of a cigarette lighter. More specifically it relates to a cord affixed at one end to the bottom of a cigarette lighter and the opposite end having a clip attachment to a person's clothes, purse, etc.

2. State of Prior Art

U.S. Pat. No. 1,835,749 shows a special compartment in a lady's pocketbook for the storage of a cigarette lighter.

U.S. Pat. No. 2,503,501 describes a tobacco pouch with a pipe bowl cleaning device attached to the handle of the zipper provided to close the pouch.

U.S. Pat. No. 3,326,258 shows a small chain used to fasten a key to the inside of a lady's handbag.

It is a common sight to see a woman searching through the various objects in her purse to locate her cigarette lighter and in some cases has in frustration emptied her purse of all the contents. Also it is a common sight to watch a man fumble in a pocket among several objects in the pocket before pulling out his cigarette lighter.

There has been no prior art found disclosing a means to facilitate the location and retrieval of a cigarette lighter in and from a lady's purse, or a man's pocket, etc.

OBJECTIVES

It is an object of this invention to design a device for locating and retrieving a cigarette lighter from a lady's purse or from a man's pocket.

It is also an object of this invention to reduce the possibility of losing or misplacing a cigarette lighter.

It is also an object of this invention to facilitate the location and retrieval of a cigarette lighter by having a means for fastening the said device to a lady's purse or a man's clothing.

SUMMARY OF THE INVENTION

In accordance with the present invention a device has been found, which accomplishes the above objectives, comprising a cord or chain, preferably an elastic cord, which has at one end a first fastening means for attaching said cord or chain to a cigarette lighter and at the opposite end a second fastening means for attaching, preferably temporarily, the cord to a convenient locating position such as a ring or zipper handle, etc., on a lady's purse, or on a man's belt, or the edge of a man's pocket or belt loop, etc. With such a device the owner can easily locate and retrieve the cigarette lighter by pulling on the cord or chain.

This first fastening means by which the cord or chain is attached to the lighter is preferably a plastic or metal plate or disk having an opening through which the cord passes and is prevented from separating from the plate or disk by a knot or otherwise enlarged end of the cord. This plate or disk is glued to the bottom of the lighter or forms a bottom part of a holder or case in the lighter and partially or completely encases the lighter.

The second fastening means by which the cord is attached to a purse or an item of a man's clothing is preferably a clip, such as a spring operated clip. Other fastening means may be used such as hooks, snaps, "Velcro" fasteners, etc.

The description of this invention is facilitated by reference to the drawings.

DESCRIPTION OF PREFERRED EMBODIMENTS

Figure 1:
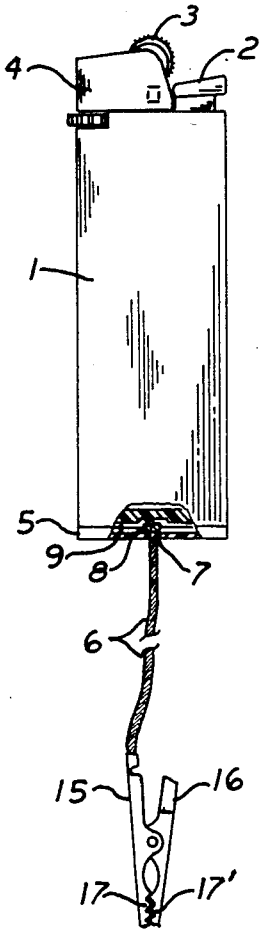
FIG. 1 is a front elevational view of a cigarette lighter having the device of this invention attached to the bottom thereof, with a partial view of the means for attaching the cord.

In FIG. 1 lighter 1 has lever 2 to operate flint wheel 3 protected by shield 4. At the bottom of the lighter, disk 5 is glued with cord 6 passing through opening 7 and knot 8 preventing separation of the cord from the disk. The opposite end of the cord is fastened to clip 15 which has a spring pressured lever arm 16 which presses teeth 17 and 17' against each other.

Figure 2:
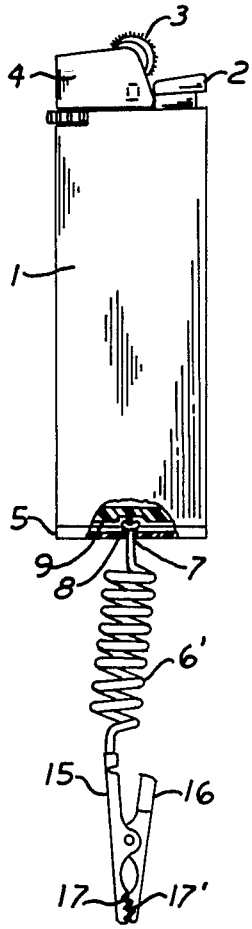
FIG. 2 is also a front elevational view with a partial cross-section of a cigarette lighter having a modified device of this invention with a spring looped cord.

FIG. 2 shows spring looped cord 6' which fits through opening 7 in disk 5 which is glued into a recess 9 in the bottom of lighter 1.

Figure 3:
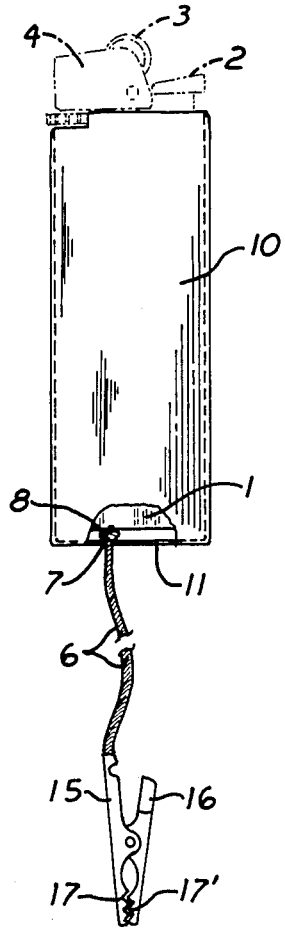
FIG. 3 is a front, elevational view of a case into which a cigarette lighter may be inserted and having a device of this invention fastened to the bottom of the case.

A holding case 10 is shown in FIG. 3 into which a lighter may be inserted. Cord 6 extends into the bottom of the case through opening 7 and is held therein by knot 8. Opening 11 is provided to push the lighter upward when it is desired to remove the lighter from the case. A broken section is given to show how the cord is fastened.

Figure 4:
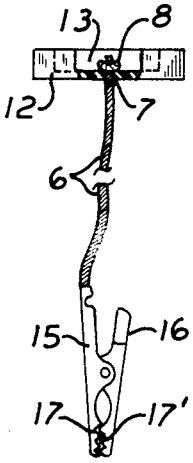
FIG. 4 is a front elevational partial cross-sectional view of a plate or disk which may be glued to the bottom of a cigarette lighter for holding a cord device of this invention to the lighter.

FIG. 4 shows disk 12 which has recess 13 into which knot 8 is placed to hold cord 6 from sliding through opening 7. Disk 12 may be glued to the bottom of a lighter to serve as described herein.

Figure 5:
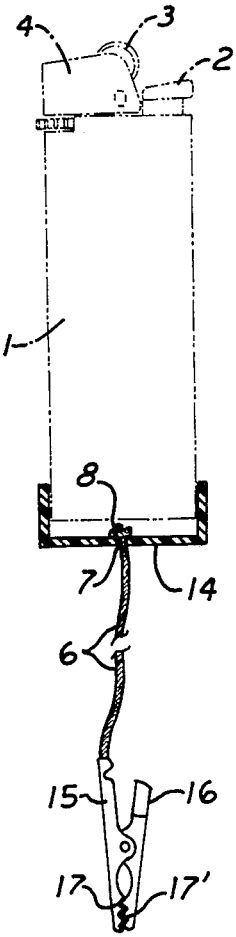
FIG. 5 is a front elevational view of a case adapted to embrace the lower part of a cigarette lighter and to fasten thereto a cord device of this invention.

FIG. 5 shows a case 14 which may be fitted snugly or glued onto the lower portion of a lighter.

FIGS. 6–9 show a new clip to be used in place of the clip shown in FIGS. 1–5. In this new clip two partial rings 18 and 19 are swivelly attached to each other and held together by spring clip 20. Lever arm 21 is attached to front partial ring 18 and lever arm 21' is attached to back partial ring 19. Each ring reaches about $\frac{2}{3}$ or about 240° of the assembled circular ring with the bottoms of the two partial rings overlapping. These overlapping portions have teeth 22 and 22' thereon opposite each other so that clothe or other sheet or fabric material caught in between will be held between these teeth sections.

Figure 6:
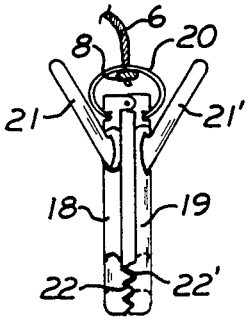
FIG. 6 is a side elevational view of a new clip suitable for attachment to the cord.

FIG. 6 is a side elevational view of this new clip.

Figure 7:
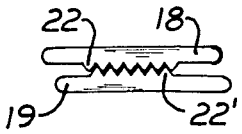
FIG. 7 is a bottom plan view of the new clip of FIG. 6.

FIG. 7 is a bottom view of this new clip.

Figure 8:
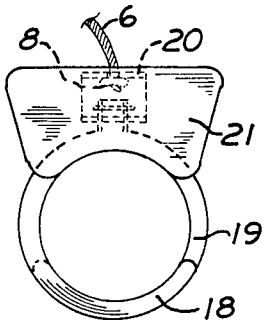
FIG. 8 is a front elevational view of the new clip of FIG. 6.

FIG. 8 is a front view of this new clip.

Figure 9:
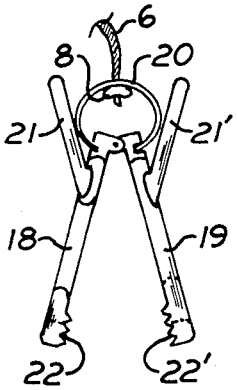
FIG. 9 is a side elevational view of the new clip of FIG. 6 in which the clip is in an opened position.

FIG. 9 is a side elevational view of this new clip in which the bottom portion of the partial rings have been spread apart by pressure on the two lever arms 21 and 21' so that any looped object such as belt loops, rings on purses, etc., can be inserted therebetween and caught inside the reassembled ring portion of the clip once the pressure on lever arms 21 and 21' has been released. If there are no looped objects which may be caught in the ring portion, clothe or other sheet material may be caught between teeth 22 and 22' and thereby held to attached cord 6 and also the lighter connected to the cord.

The device of this invention makes very simple the location and retrieval of a cigarette lighter. It makes it possible to avoid the very annoying and frustrating practice of having to search among numerous items in a purse to find the lighter. It also eliminates or substantially reduces the possibility of losing the lighter.

While certain features of this invention have been described in detail with respect to various embodiments thereof, it will of course be apparent that other modifications can be made within the spirit and scope of this invention and it is not intended to limit the invention to the exact details shown except insofar as they are defined in the following claims.

The invention claimed is:

1. A device for locating and retrieving a cigarette lighter comprising a cord or chain having at one end of said cord or chain a first fastening means for fastening said cord or chain to the bottom of said cigarette lighter and having at the other end of said cord or chain a second fastening means for fastening said cord or chain to a portion of a lady's purse or to an article of a man's clothing, in which said cord or chain is an elastic cord, and in which said second fastening means is a clip which comprises (a) two partial rings swivelly held together at a top portion of the two partial rings said partial rings overlapping each other so as to form a complete ring when in a closed position, said partial rings each having a lever arm which serve to push the bottom portions of the two rings apart from each other when pressure is exerted to push the lever arms toward each other so that a looped object when inserted therebetween will be caught in the reassembled ring when the said pressure is released and the partial rings returned to a closed position, (b) a spring means positioned at the swivelly held portions of said two partial rings whereby pressure is exerted to press said partial rings against each other; and (c) two lever arms, one of which is attached to one of said partial rings and the other attached to the other of said partial rings whereby pressure exerted to press said lever arms toward each other will cause the bottom portion of said partial rings to separate from each other.

2. The device of claim 1 in which said cord is fastened to the bottom of a casing into which the lighter is fitted.

3. A device for locating and retrieving a cigarette lighter comprising a cord or chain having at one end of said cord or chain a first fastening means for fastening said cord or chain to the bottom of said cigarette lighter and having at the other end of said cord or chain a second fastening means for fastening said cord or chain to a portion of a lady's purse or to an article of a man's clothing, in which said cord or chain is an elastic cord which is fastened to a plate of appropriate size which plate is glued to the bottom of said lighter, and in which said second fastening means is a clip which comprises (a) two partial rings swivelly held together at a top portion of the two partial rings said partial rings overlapping each other so as to form a complete ring when in a closed position, said partial rings each having a lever arm which serve to push the bottom portions of the two rings apart from each other when pressure is exerted to push the lever arms toward each other so that a looped object when inserted therebetween will be caught in the reassembled ring when the said pressure is released and the partial rings returned to a closed position, (b) a spring means positioned at the swivelly held portions of said two parallel rings whereby pressure is exerted to press said partial rings against each other; and (c) two lever arms, one of which is attached to one of said partial rings and the other attached to the other of said partial rings whereby pressure exerted to press said lever arms toward each other will cause the bottom portion of said partial rings to separate from each other.

4. A device for locating and retrieving a cigarette lighter comprising a cord or chain having at one end of said cord or chain a first fastening means for fastening said cord or chain to the bottom of said cigarette lighter and having at the other end of said cord or chain a second fastening means for fastening said cord or chain to a portion of a lady's purse or to an article of a man's clothing, in which said second fastening means is a clip which comprises (a) two partial rings swivelly held together at a top portion of the two partial rings said partial rings overlapping each other so as to form a complete ring when in a closed position, said partial rings each having a lever arm which serve to push the bottom portions of the two rings apart from each other when pressure is exerted to push the lever arms toward each other so that a looped object when inserted therebetween will be caught in the reassembled ring when the said pressure is released and the partial rings returned to a closed position, (b) a spring means positioned at the swivelly held portions of said two partial rings whereby pressure is exerted to press said partial rings against each other; and (c) two lever arms, one of which is attached to one of said partial rings and the other attached to the other of said partial rings whereby pressure exerted to press said lever arms toward each other will cause the bottom portion of said partial rings to separate from each other.

5. The device of claim 4 in which said cord chain is fastened to the bottom of a casing into which said lighter is fitted.

6. A clip which comprises (a) two partial rings swivelly held together at a top portion of the two partial rings said partial rings overlapping each other so as to form a complete ring when in a closed position, said partial rings each having a lever arm which serve to push the bottom portions of the two rings apart from each other when pressure is exerted to push the lever arms toward each other so that a looped object may be inserted therebetween and be caught in the reassembled ring when the said pressure is released and the partial rings returned to a closed position, (b) a spring means positioned at the swivally held portions of said two partial rings whereby pressure is exerted to press said partial rings against each other; and (c) two lever arms, one of which is attached to one of said partial rings and the other attached to the other of said partial rings whereby pressure exerted to press said lever arms toward each other will cause the bottom portion of said partial rings to separate from each other.

* * * * *